United States Patent [19]

Takeda et al.

[11] Patent Number: 4,468,947

[45] Date of Patent: Sep. 4, 1984

[54] DIE

[75] Inventors: Tooru Takeda; Masakatsu Hayakawa; Yasuo Inoue, all of Aichi, Japan

[73] Assignee: NGK Spark Plug Co., Ltd., Aichi, Japan

[21] Appl. No.: 335,034

[22] Filed: Dec. 28, 1981

[30] Foreign Application Priority Data

Dec. 27, 1980 [JP] Japan ..... 55-185392

[51] Int. Cl.[3] ..... B21C 3/02

[52] U.S. Cl. ..... 72/467

[58] Field of Search ..... 72/467, 274; 76/107 A

[56] References Cited

U.S. PATENT DOCUMENTS

| | | | |
|---|---|---|---|
| 1,935,821 | 11/1933 | Simons | 72/467 |
| 2,164,750 | 7/1939 | Nadler, Jr. | 72/467 |
| 2,252,365 | 8/1941 | Fisher | 72/467 |
| 2,636,828 | 4/1953 | Nicholson | 72/467 |
| 2,882,759 | 4/1959 | Altwicker | 72/467 |
| 3,440,862 | 4/1969 | Phillips, Jr. | 72/467 |
| 3,680,354 | 8/1972 | Phillips, Jr. | 72/467 |
| 3,705,509 | 12/1972 | Haller | 72/467 |
| 4,270,380 | 6/1981 | Gulati et al. | 72/467 |

FOREIGN PATENT DOCUMENTS

| | | | |
|---|---|---|---|
| 2818171 | 12/1978 | Fed. Rep. of Germany | 72/467 |
| 2135177 | 12/1972 | France | 72/467 |
| 2306756 | 11/1976 | France | 72/467 |
| 549407 | 11/1942 | United Kingdom | 72/467 |
| 565080 | 10/1944 | United Kingdom | 72/467 |
| 584016 | 1/1947 | United Kingdom | 72/467 |
| 1289730 | 9/1972 | United Kingdom | 72/467 |
| 1390035 | 4/1975 | United Kingdom | 72/467 |

*Primary Examiner*—Daniel C. Crane

*Attorney, Agent, or Firm*—Sughrue, Mion, Zinn, Macpeak and Seas

[57] ABSTRACT

A die is described, comprising a die body and a steel case, characterized in that: a die body made of a silicon nitride ceramic or a silicon carbide ceramic is shrink fitted or force fitted into a steel case wherein an optional wide recess may be cut in the inner surface of the bottom of said steel case along a corner where the bottom and the inner wall of said steel case meet.

3 Claims, 6 Drawing Figures

DIE

FIELD OF THE INVENTION

This invention relates to dies used for extruding, drawing or peeling, more particularly, to a die which is used to draw a material into a product of excellent surface quality and of high durability, even when the same is used in hot extruding.

DEVELOPMENT OF THE INVENTION

Dies of the above type are used under extreme conditions, as is well known. Accordingly, over the years various attempts have been made to improve such dies, e.g., by changing materials of construction or by fitting the die body into a steel case with a protective material interposed therebetween.

Carbide dies have been extensively employed for cold drawing while dies made of an SKD material have been used for hot extruding. These dies are excellent in performance when compared with other dies; however, they suffer from various defects, e.g., durability is insufficient and the products produced using the same are unsatisfactory in surface quality. When such dies are used for hot extruding at high temperatures (1,000° to 1,200° C.), such are rapidly worn, and as a result product manufacturing cost is high.

In addition to carbide dies, an alumina ceramic die is also available. In the case of such a die, the die body is fitted into a steel case, with a protective material interposed therebetween, as disclosed in Japanese Patent Publication Nos. 3180/1968 and 30102/1978. Such a conventional die is shown in FIG. 1. In FIG. 1, reference numeral 1 designates an alumina ceramic die body. The die body is fitted in steel case 3 after being covered with synthetic resin or synthetic rubber 2 or interposed material 2 of a soft metal.

This procedure is relatively effective in complementing the brittleness of the die body, in reducing the frictional resistance of the die body to prevent die seizure and oxidation and in preventing damage or deformation of the die surface. However, such a die structure still suffers from the following defects: (1) A synthetic resin or synthetic rubber or an interposed material of soft metal cannot be used in hot extruding. (2) As the alumina ceramic die body has relatively low heat and impact resistance, the die is not suitable for cold drawing, especially in hot extruding. Further, die durability is insufficient when a product diameter is large, e.g., 20 to 40 mm $\phi$.

SUMMARY OF THE INVENTION

One object of this invention is to provide a die in which the above described problems have been solved and which is suitable for manufacturing products of a large diameter, e.g., 20 to 40 mm $\phi$, with excellent surface quality at temperatures ranged from a relatively low temperature to a relatively high temperature, e.g., 1,250° C., by cold drawing or hot extruding, which die is of high durability.

Per the present invention, a steel case is used to receive the die wherein an optional wide recess is cut in the inner surface of the bottom of the steel case along the corner where the bottom and the inner wall of the steel case meet and a die body made of a silicon nitride ceramic or a silicon carbide ceramic is shrink fitted or force fitted into the steel case. The optional wide recess in the case is intended to exert a compressive stress on the die body in the axial direction.

DESCRIPTION OF PREFERRED EMBODIMENTS

As indicated in Table 1 below, the wear resistance of the die of the invention is more than 4.5 times that of a die made of a carbide or alumina ceramic in the case of cold drawing and is more than 4.8 times that of a die of SKD-61 or alumina ceramic in hot extruding at 450° C. In hot extruding at 1,200° C., the wear resistance is more than 30 times that of a die made of SKD-61 or alumina ceramic.

The reasons why the wear resistance of a die according to the invention is considerably high as described above are as follows: Silicon nitride ceramics and silicon carbide ceramics are very low in reactivity and high in wear resistance when compared with Al or Fe, typical materials to be drawn or extruded. Among ceramic materials, silicon nitride ceramics and silicon carbide ceramics are high in strength and hardness, and these properties do not substantially deteriorate at room temperature or at high temperature. A further improvement is achieved when the optional compression stress is exerted on the die body in the axial direction due to the described modification of the steel case.

Due to the above described improvements, products manufactured using the die of the invention are free from defects and have excellent surface quality as compared to those manufactured using dies made of materials other than those employed in the invention. The service life of dies according to the invention is lengthened by the improved structure of the same.

Various embodiments of this invention will now be described with reference to the accompanying drawing in more detail.

Figure 2A:
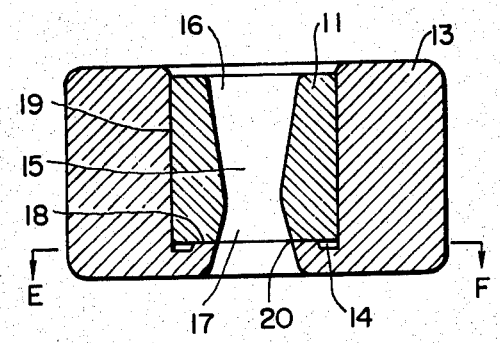
FIG. 2A is a sectional side view of one example of a die according to this invention, in which an annular recess is formed in the bottom of a steel case.
Figure 2B:
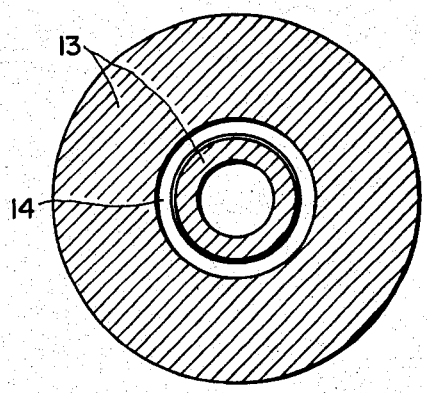
FIG. 2B is a sectional view taken along line E–F in FIG. 2A.

FIG. 2A is a sectional side view of a cold drawing die and FIG. 2B is a sectional view taken along line E–F in FIG. 2A. In the figures, reference numeral 11 designates a die body of silicon nitride ceramic or silicon carbide ceramic which has a drawing hole 15 at the center thereof. Drawing hole 15 has a curved surface suitable for drawing a work-piece. A work-piece inserted into die body 11 through inlet 16 is pulled from outlet 17 while being drawn in a conventional manner suitably. Die body 11 is surrounded by case 13 made of steel and is shrink fitted or force fitted into case 13. Case 13 has a ring-shaped recess (or groove) 14 along the corner where the inner wall 19 and the inner bottom 18 of case 13 meet so that when an extruding or drawing force is imparted to the die body, a compressive stress is exerted on the inner surface of case 13 with the die body being supported by the case.

Figure 1:
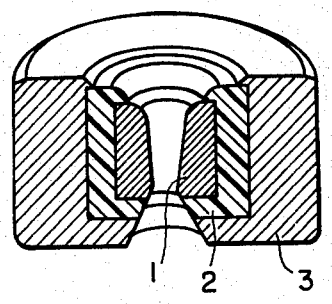
FIG. 1 is a perspective view of one example of a conventional die, which is sectioned.
Figure 4:
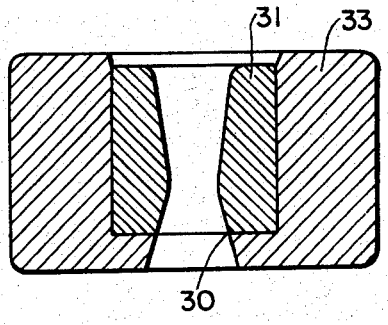
FIG. 4 is a sectional side view of a third example of the die according to the invention, in which no annular recess is formed in the bottom of the case.

The above described die body made of silicon nitride ceramic or silicon carbide ceramic is excellent in reactivity (which is low), wear resistance and heat resistance; however, it is relatively low in rigidity. Therefore, if a high tensile stress is applied to the case, the latter is liable to crack. Accordingly, generation of compressive stress by shrink fitting or force fitting the die body into the case is effective to prevent the occurrence of circumferential cracks. However, with respect to axial cracks, the following problem is encountered: In drawing a work-piece, the drawing force is particularly exerted on contact region 20 between outlet 17 of die body 11 and steel case 13. In the case of using a steel case having a structure as shown in FIG. 4, even if shrink fitting or force fitting is employed, a gap is liable to be formed in contact region 30 between case 33 and die body 31. In this situation, it is believed that the steel case does not function as a holder for the die body.

On the other hand, in the embodiment of FIG. 2, recess 14 is formed in the inner bottom of the opening in steel case 13, so that the contact area between steel case 13 and die body 11 is decreased, i.e., the gap in contact region 20 is decreased, and die body 11 is in contact with the innermost annular part of the inner bottom of case 13 which is defined by recess 14. Because of this construction, the pressure which die body 11 can withstand is increased and the tensile stress applied to die body 11 in the axial direction is minimized. Accordingly, the problem that the die body cracks in the axial direction as described above is eliminated, which results in increased service life.

Figure 3A:
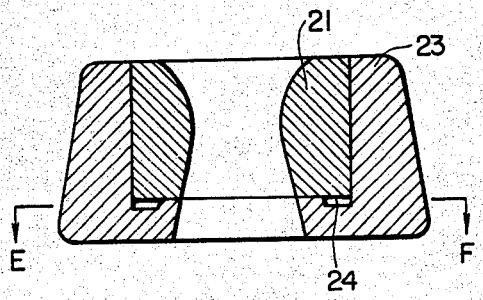
FIG. 3A is a sectional side view showing another example of the die according to the invention.
Figure 3B:
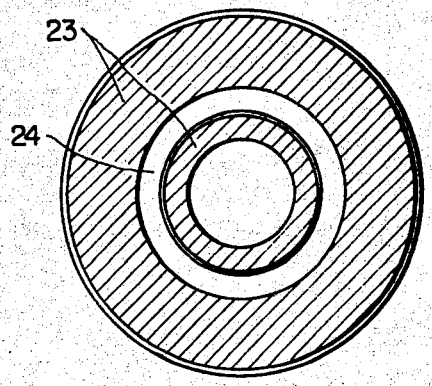
FIG. 3B is a sectional view taken along line E–F in FIG. 3A.

FIG. 3A is a sectional side view of a hot die, and FIG. 3B is a sectional view taken along line E–F in FIG. 3A. In these figures, reference numeral 21 designates a die body made of silicon nitride ceramic or silicon carbide ceramic, which die body 21 is shrink fitted or force fitted into steel case 23. Reference numeral 24 designates a ring shaped recess which is similar to recess 14 in FIG. 2.

FIG. 4 is a sectional side view of a conventional cold drawing die whose structure is such that no recess is formed in the inner surface of the bottom of the hollow steel case.

A specific example of the recess (groove) according to the invention will be described. The width of the recess is in a range of 5 to 7 mm, the depth thereof is in a range of 0.3 to 0.7 mm, such that the ratio of width-/depth ranges from 7.14/1 (5 mm/0.7 mm) to 23.33/1 (7 mm/0.3 mm), and the width of the contact area between the steel case and the die body is approximately 8 mm when the diameter of the die body is in a range of 40 to 65 mmϕ.

A comparison test was carried out as shown in Table 1 below, in which SUS 304 or an aluminum alloy was drawn or extruded to 30 mm in diameter with a die of the invention and conventional die of carbide, SKD-61 or alumina ceramic.

TABLE 1

| Condition | Material | Die | Number of drawn pieces (*Note 1) | Remarks |
|---|---|---|---|---|
| 1200° C. Hot extruding | SUS 304 | Case with recess, Silicon nitride ceramic body | 40 | Invention |
| | | Case with recess, Silicon carbonate ceramic body | 35 | Invention |
| | | Ordinary case (without recess), Silicon nitride ceramic body | 30 | Invention |
| | | Conventional alumina ceramic body | 0.5 | Comparison |
| | | Conventional SKD-61 body | 1 | Comparison |
| 450° C. Hot extruding | Al alloy | Case with recess, Silicon nitride ceramic body | 800 | Invention |
| | | Ordinary case (without recess), Silicon nitride ceramic body | 720 | Invention |
| | | Conventional Alumina ceramic body | 50 | Comparison |
| | | Conventional SKD-61 body | 150 | Comparison |
| Cold drawing | SUS 304 | Case with recess, Silicon nitride ceramic body | 1000 | Invention |
| | | Ordinary (without recess), Silicon nitride ceramic body | 900 | Invention |
| | | Conventional alumina ceramic body | 100 | Comparison |
| | | Conventional carbide body | 200 | Comparison |

*Note 1: Each piece was 30 m long.

The products of the die of the invention were more excellent in surface gloss and external appearance than those obtained using the conventional dies, although not indicated in Table 1.

Thus, the die of the invention enables one to greatly increase the number of extruded or drawn pieces and to manufacture products of improved quality as compared with conventional dies. In Table 1, Fe and Al alloy materials are indicated; however, the range of application of the die according to the invention is much wider; for example, the die can be equally applied to extrude or draw other materials such as Ti and nonferrous metals with excellent results.

Since the die body can be readily manufactured and can be relatively readily fitted in the steel case, the die of the invention can be fabricated at low manufacturing cost. Thus, the industrial effect of the invention should be highly appreciated.

While the invention has been described in detail and with reference to specific embodiments thereof, it will be apparent to one skilled in the art that various changes and modifications can be made therein without departing from the spirit and scope thereof.

We claim:

1. A die comprising a die body and a steel case, comprising:

a steel case comprising a cavity defined by an inner wall and a bottom wall converging at a corner, a die body made of silicon nitride ceramic or a silicon carbide ceramic shrink fitted or force fitted into the cavity of said steel case, said die body having a side surface and a bottom surface engaging the inner wall and the bottom wall of said steel case, respectively, and a wide recess having a width/depth ratio of from 7.14/1 to 23.33/1 cut in the inner surface of the bottom wall of said steel case along said corner where the bottom and the inner wall of said steel case meet so that a portion of the die body bottom surface is equal to said width of said recess and is unsupported.

2. A die as in claim 1, wherein the die body is made of a silicon nitride ceramic.

3. A die as in claim 1, wherein the die body is made of a silicon carbide ceramic.

* * * * *